United States Patent [19]

Chen et al.

[11] 4,428,116

[45] Jan. 31, 1984

[54] SUPPORT FOR RELEASABLY RETAINING A BLADE CARTRIDGE

[75] Inventors: Evan N. Chen, Fairfield; Frank A. Ferraro, Trumbull, both of Conn.

[73] Assignee: Warner-Lambert Company, Morris Plains, N.J.

[21] Appl. No.: 478,423

[22] Filed: Mar. 24, 1983

Related U.S. Application Data

[63] Continuation of Ser. No. 239,847, Mar. 2, 1981, abandoned.

[51] Int. Cl.[3] ..... B26B 21/06

[52] U.S. Cl. ..... 30/87; 30/47; 30/57; 30/89

[58] Field of Search ..... 30/47, 87, 89, 57

[56] References Cited

U.S. PATENT DOCUMENTS

| | | | |
|---|---|---|---|
| 4,198,746 | 4/1980 | Trotta | 30/47 |
| 4,266,340 | 5/1981 | Bowman | 30/47 |
| 4,281,455 | 8/1981 | Dixon et al. | 30/47 |

*Primary Examiner*—E. R. Kazenske
*Assistant Examiner*—Willmon Fridie, Jr.
*Attorney, Agent, or Firm*—R. S. Strickler

[57] ABSTRACT

A shaving instrument including an elongated support terminating in a yoke with an attached slide cooperating with the support to facilitate receiving and retaining a blade cartridge in pivotal and releasable fashion in the yoke.

1 Claim, 8 Drawing Figures

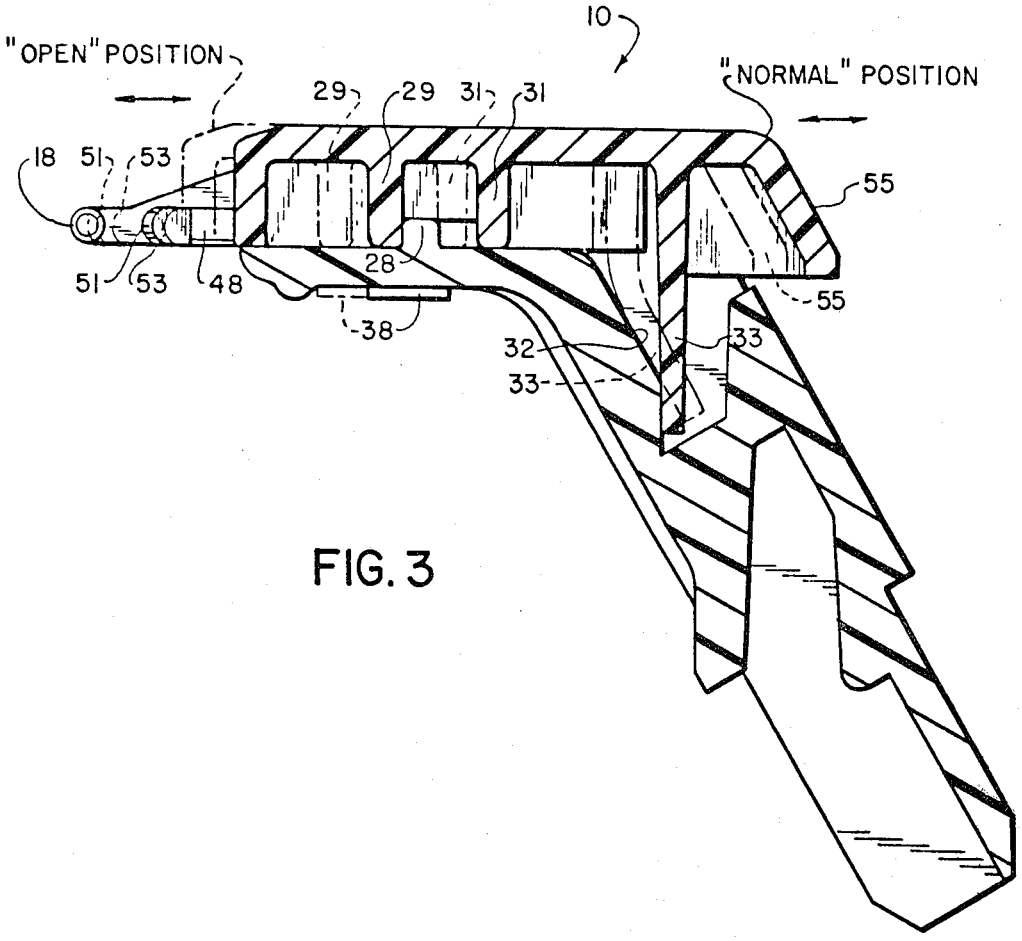
FIG. 3
FIG. 4
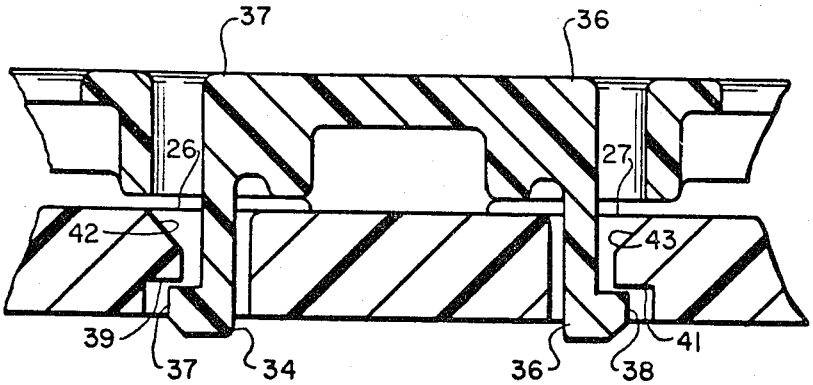

SUPPORT FOR RELEASABLY RETAINING A BLADE CARTRIDGE

This is a continuation of application Ser. No. 239,847 filed Mar. 2, 1981, now abandoned.

BACKGROUND OF THE INVENTION

The invention relates to wet shaving instruments and pertinent prior art devices over which the present disclosure is an improvement are illustrated and described in U.S. Pat. No. 4,094,063 dated June 13, 1978, and in U.S. Pat. No. 4,198,746 dated Apr. 22, 1980, both issued to Robert Anthony Trotta and both assigned on the face of each patent to The Gillette Company, Boston, Mass.

The '063 patent shows a blade unit or blade cartridge pivotally mounted in a yoke with a cam and a resiliently mounted cam follower for biasing the cartridge toward a central position.

The '746 patent shows a flexible yoke and a slide for spreading the yoke to receive releasably a blade cartridge. The patent also shows a biasing spring, similar to that of the '063 disclosure, mounted within the yoke and extending from the razor handle.

SUMMARY OF THE INVENTION

The principal object of the invention is to provide a simplified shaving instrument having a minimum number of piece parts operative to receive pivotally and retain releasably a single or multiple cutting edge blade cartridge or shaving unit of well known configuration, representative examples of which are identified by the reference numeral 2 in said Trotta patents.

Thus, the detailed structure of the blade cartridge or shaving unit is not critical to this invention so long as the cartridge, having one or more cutting edges, is of the type which can be gripped releasably and pivotally in a manner similar to the mounting method described in the '746 patent.

It is a further feature of the invention to provide a slide element connected to and movable freely relative to a support where the slide includes spring means, latch means, guide means and aligning means all cast or molded simultaneously with the slide to form a single piece-part.

A still further feature of the invention is to provide an elongated support terminating in a flexible yoke and an attached movable slide making a total of two (2) piece-parts cooperating to receive pivotally and retain releasably a single or multiple cutting edge blade cartridge.

It is a further feature of the invention to provide a unique slide structure cooperating with a correspondingly unique support structure.

A shaving instrument embracing certain features of the present invention may comprise an elongated support terminating in a flexible yoke for receiving pivotally and retaining releasably a blade cartridge, a slide element cooperating with said yoke and connected to said support, said slide element being movable relative to the support from a first or normal position in which said yoke is closed to a second position in which said slide element operates to flex the yoke outwardly to condition the yoke to receive said blade cartridge and spring means forming a single piece-part in combination with the slide element operable to return said slide element to said first position to permit the yoke to flex inwardly to retain releasably a cartridge received in the yoke.

BRIEF DESCRIPTION OF DRAWINGS

Other features and advantages of the present invention will become more apparent from an examination of the following specification when read in conjunction with the appended drawings in which:

FIG. 3 is a central, vertical section of FIG. 1 (with the slide assembled to the elongated support) as observed in the plane represented by the line 3–3 showing the first and second positions of the slide;

FIG. 4 is a transverse, vertical section of FIG. 1 (with the slide and support assembled) taken along the plane of the line 4–4 showing the connection between the slide and the support;

DESCRIPTION OF PREFERRED EMBODIMENT

Figure 1:
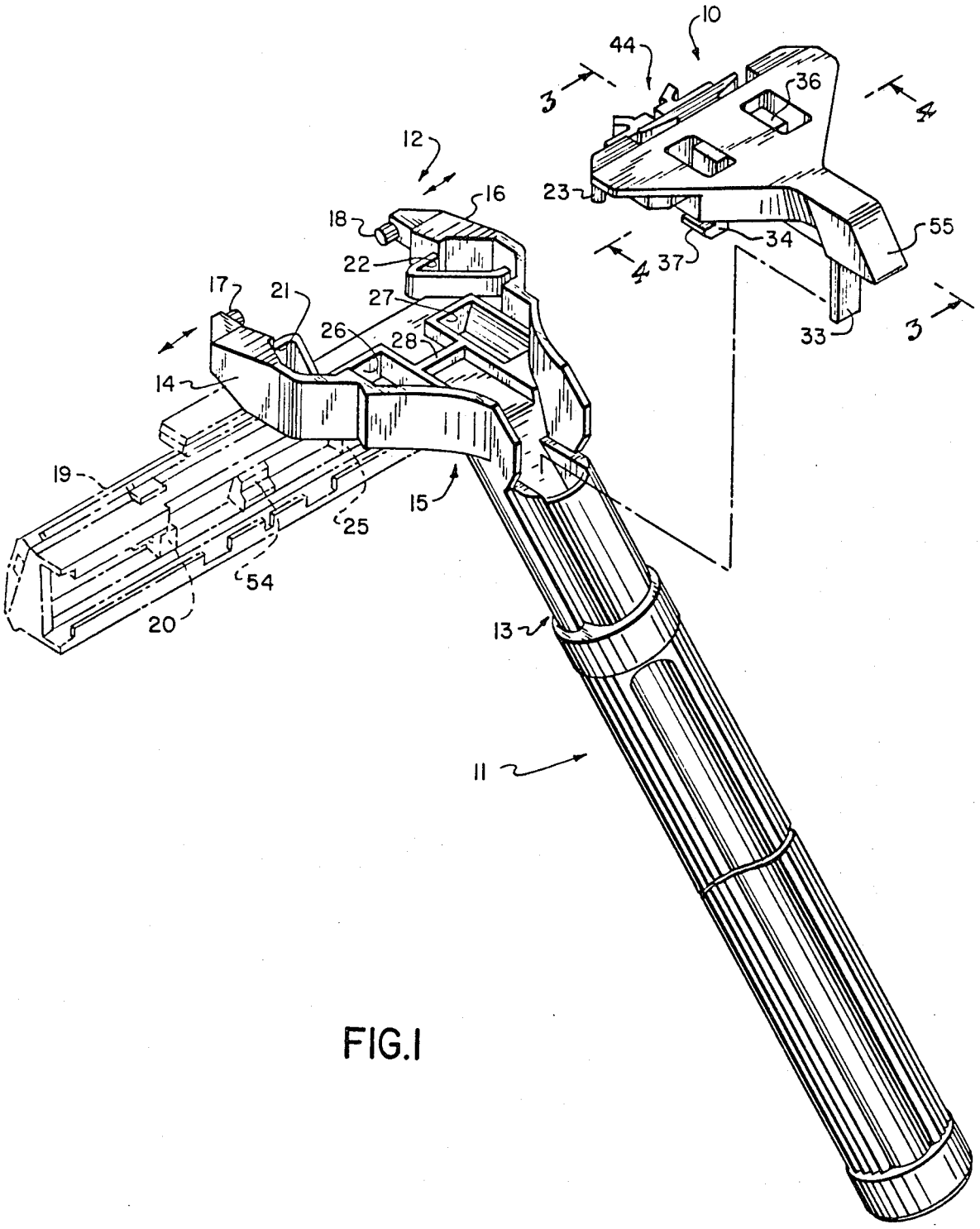
FIG. 1 is a perspective, exploded view of a shaving instrument embracing the principles of the invention with the blade cartridge shown in phantom.
Figure 2:
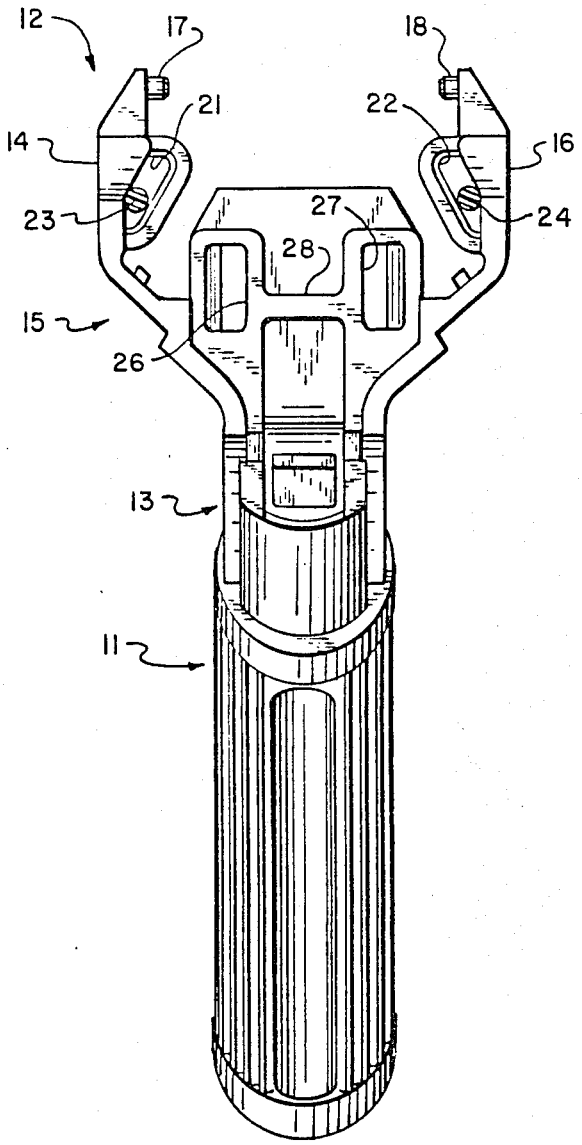
FIG. 2 is similar to FIG. 1 showing the elongated support terminating in a yoke with the slide removed.
Figure 5:
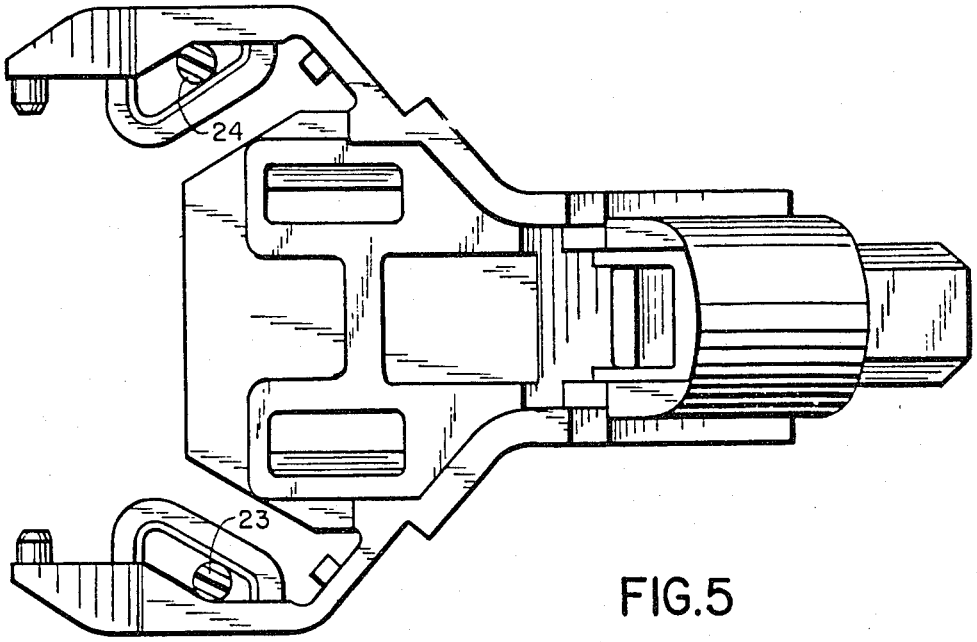
FIG. 5 is a plan view of the support at the junction of the flexible yoke.

Referring in detail to the drawings, the reference numeral 10 designates a slide connected to an elongated support 11 terminating at one end in a flexible yoke or yoke portion 12 and terminating at the opposite end in a stem portion 13 with the yoke-stem junction indicated by the reference numeral 15.

The yoke 12 includes flexible plastic arms 14 and 16 each formed with a stub shaft 17–18. The arms have sufficient resilience and "memory" to flex to and fro (as shown by the arrows of FIG. 1) in well known fashion to receive pivotally and retain releasably a blade cartridge 19 in that stub shafts 17 and 18 are received in mating bearings or bore holes formed in transverse ribs 20 and 25 of cartridge 19.

The arms 14 and 16 are each formed with a cam follower 21 and 22 defining a loop or an aperture. Each follower 21–22 is driven by a mating cam 23–24 depending from slide 10 (see FIGS. 2, 5, 6 and 7) to flex the arms 14 and 16 and thus move stub shafts 17 and 18 away from one another as a result of slide action which becomes more apparent as this specification proceeds.

The yoke-stem junction 15 of the elongated support 11 is formed with a pair of slots 26–27 defining tracks for guiding slide 10 as the slide moves relative to the support to effect spreading of the arms 14–16.

The yoke-stem junction is also formed with a rib 28 which cooperates with spaced abutments 29 and 31 (see FIG. 3) to limit the stroke of movable slide 10.

Shoulder 32 provides a bearing surface for a leaf spring 33 (first spring element) depending from slide 10 to provide the main power source to return slide 10 from the second or "open" position (cartridge-receiving position) to the first or normal position (cartridge-retaining position).

Figure 7:
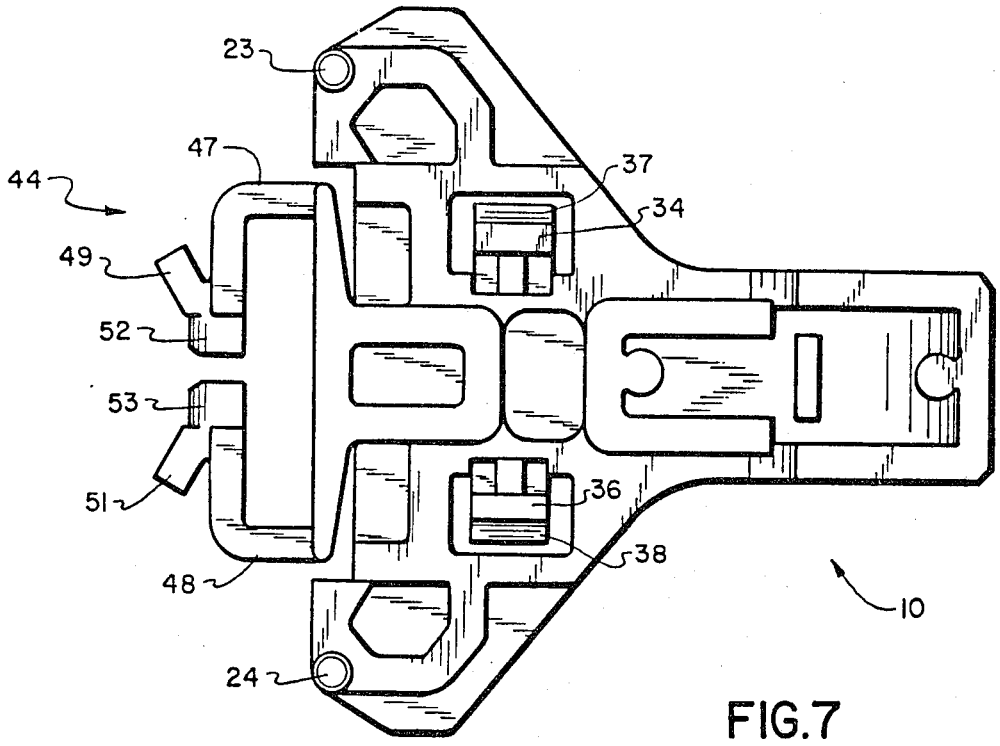
FIG. 7 is a plan view of the bottom side of the slide.

Referring to the underside of the slide 10, best observed in FIG. 7, the slide is further formed with two projections or protuberances 34–36 each terminating in a claw 37–38.

As is most apparent in FIG. 4, the projections 34–36 are received in mating slots 26–27 effective to guide or track the slide 10 during its motion relative the elongated support 11. The claws 37 and 38 engage mating lips 39–41 on the outer periphery of tracks 26–27 to latch the slide 10 to the elongated support 11 so that the slide is permanently connected to the support but free to be moved manually or otherwise in sliding fashion relative to the support.

The latching connection is possible because during assembly of the slide 10 to the elongated support 11 the slide is placed in register with the stem-yoke junction 15 with the protuberances 34 and 36 poised to enter mating slots 26 and 27.

With the slide and the elongated support so positioned, the slide is pressed into contact with the support and as the claws 37–38 progress down ramps 42 and 43 the protuberances or projections 34 and 36 flex inwardly. Pressing continues until the claws reach the bottom of ramps 42 and 43 whereupon the claws, by virtue of the "memory" inherent in the projections 34 and 36, snap outwardly overlapping lips 39 and 41 to latch the slide to the support to make the permanent sliding connection referred to previously.

As stated earlier, the slide is also formed with cams 23 and 24 which engage followers 21 and 22 to drive or spread yoke arms 14 and 16. The tendency for the yokes to return to the closed position provides auxiliary power, through cams 23–24 and mating followers 21 and 22, to return the slide to the normal or first position.

Figure 6:
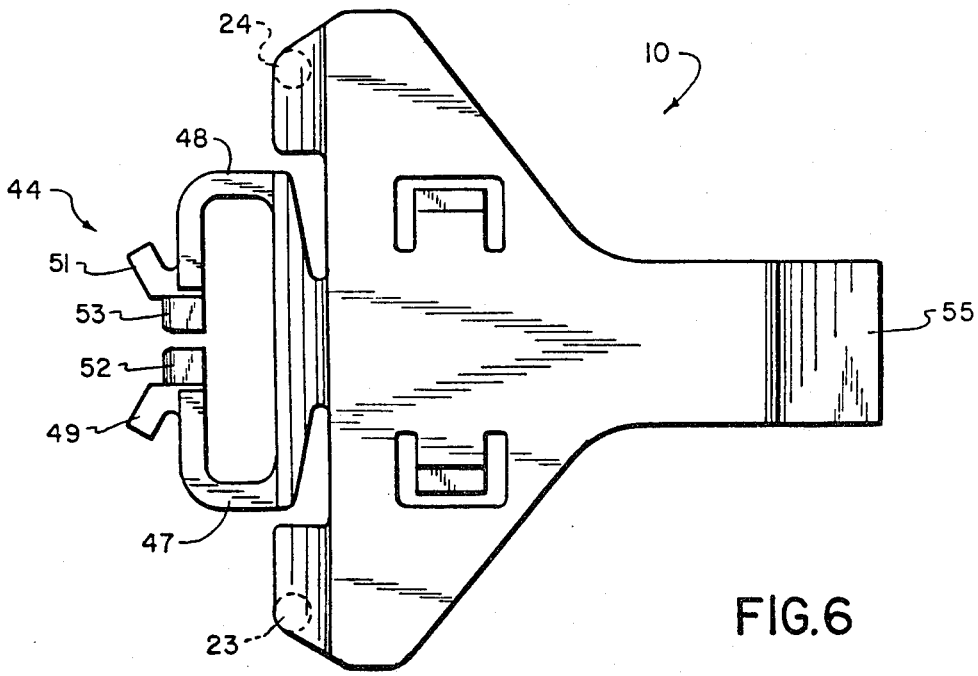
FIG. 6 is a plan view of the top side of the slide.
Figure 8:
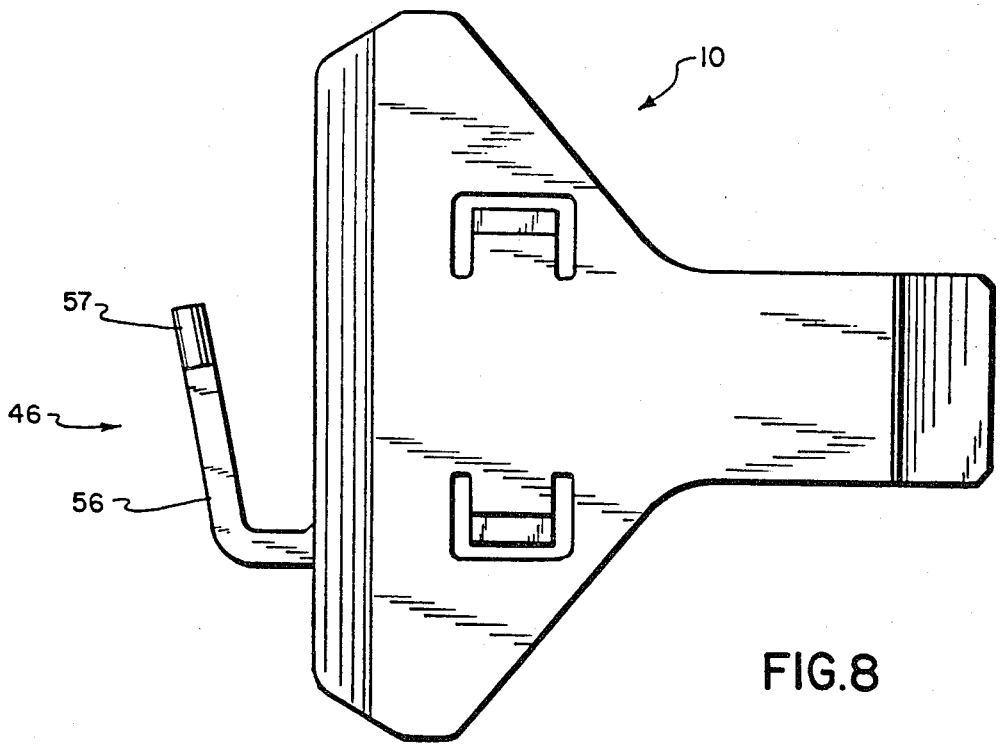
FIG. 8 is a plan view of the top side of an alternative embodiment of the slide.

The slide 10 is also formed with an additional (additional to leaf spring 33) or second spring element identified generally by the reference numeral 44 in FIG. 6 (the preferred embodiment) and by the reference numeral 46 in FIG. 8 (an alternative embodiment).

The second spring element 44 comprises a pair of opposed, resilient L-shaped members 47–48 including aligning means taking the form of flaring fingers 49 and 51 cast integral with members 47–48.

The L-shaped members 47 and 48 terminate at their free ends in cam followers 52 and 53. The followers 52 and 53 engage and bear resiliently upon cam 54 carried by blade cartridge 19 (see FIG. 1) to bias the pivotally mounted cartridge toward a preferred attitude relative to elongated support 11 in a manner and for a purpose which is well known.

The flared fingers 49 and 51, referred to in the claims as an aligning means, function to insure centering the yoke relative to the cartridge in that the flared fingers 49 and 51 straddle the cam 54 and "home" the yoke into the cartridge.

An alternative embodiment of the second spring element is shown in FIG. 8 indicated by the reference numeral 46. In this arrangement, slide 10 includes a single L-shaped member 56 terminating in a single cam follower 57 which operates to engage cam 54 in the same manner and for fhe same reason as described in connection with second spring element 44.

The operation of the shaving instrument occurs as follows.

Assume that the slide 10 is in the normal or first position with the yoke empty (solid line position of FIG. 3). The slide is held in this position mainly by leaf spring 33 with auxiliary force provided by the resilience of the yoke in that the arms 14 and 16 are purposely held under light restraint, i.e., held with a tendency or a "desire" to flex further inwardly. That is, the design of the instrument is such that when the slide is in the first or normal position as shown in FIG. 3, the arms 14 and 16 are not fully relaxed and thus apply auxiliary pressure upon the slide 10, through followers 21 and 22 and cams 23 and 24, further urging the abutment 29 into contact with rib 28.

By manually depressing tab 55, the slide is moved to the second position and the yoke arms 14 and 16 are spread in condition to receive a blade cartridge in well known fashion.

In the case of the preferred second spring structure indicated by reference numeral 44 in FIG. 6, the flared fingers 49 and 51 facilitate centering the yoke relative to the blade cartridge.

After contact is made with blade cartridge, release of the tab 55 permits the yoke to grasp the blade cartridge (stub shafts 17 and 18 engage mating bore holes in transverse ribs 20 and 25-FIG.1) and the leaf spring 33, the residual spring action of the yoke arms 14 and 16 plus the spring action of the second spring element 44 or 46, as the case may be, coact to hold the cartridge releasably and pivotally with the main holding forces originating in the first spring element or leaf spring 33.

It is anticipated that a wide variety of modifications may be devised as engineering and production considerations require, without departing from the spirit and scope of the invention.

We claim:

1. A support assembly for releasably retaining a razor blade cartridge comprising two relatively movable plastic elements defining a slide and a cooperating support, said support being formed with tracks for receiving and guiding projections depending from the slide, each said projection terminating in a claw operable to latch the slide permanently and slidably to the support, said support defining further a yoke having a pair of flexible arms each terminating in a stub shaft, said slide making a driving connection with said arms operative to flex the arms to open and closed positions, said slide being formed further with a plurality of individual spring means, a first spring means defining a leaf spring providing power urging the slide to its normal position relative to the track and by virtue of the driving connection between the slide and the arms insuring that the arms flex inwardly to said closed position in positive and automatic fashion to retain a cartridge releasable within the yoke and a second spring means defining a pair of L-shaped springs for urging the cartridge toward a predetermined attitude and flared fingers carried by said second spring means for homing the assembly toward the cartridge, said support being formed further with a rib straddled by a pair of spaced abutments carried by the slide to limit the stroke of the slide.

* * * * *